US005873739A

United States Patent [19]

Roberts

[11] Patent Number: 5,873,739

[45] Date of Patent: Feb. 23, 1999

[54] DIRECT CIRCUIT TO CIRCUIT STORED ENERGY CONNECTOR

[75] Inventor: Joseph A. Roberts, Hudson, N.H.

[73] Assignee: Miraco, Inc., Nashua, N.H.

[21] Appl. No.: 645,671

[22] Filed: May 14, 1996

[51] Int. Cl.[6] ..... H01R 9/09

[52] U.S. Cl. ..... 439/67; 439/493

[58] Field of Search ..... 439/67, 493, 494, 439/495, 499, 634, 635, 636, 77

[56] References Cited

U.S. PATENT DOCUMENTS

| | | | |
|---|---|---|---|
| 4,023,877 | 5/1977 | Hennessey et al. . | |
| 4,023,878 | 5/1977 | Hennessey . | |
| 4,334,728 | 6/1982 | Reynolds et al. . | |
| 4,420,203 | 12/1983 | Aug et al. . | |
| 4,630,874 | 12/1986 | Renn et al. | 439/495 |
| 4,690,472 | 9/1987 | Elco et al. | 439/67 |
| 4,718,859 | 1/1988 | Gardner | 439/329 |
| 4,740,867 | 4/1988 | Roberts et al. | 361/389 |
| 4,824,379 | 4/1989 | Roberts et al. | 439/77 |
| 4,936,792 | 6/1990 | Onoue et al. | 439/329 |
| 4,944,690 | 7/1990 | Imai | 439/495 |
| 4,969,828 | 11/1990 | Bright et al. | 439/68 |
| 4,975,068 | 12/1990 | Squires | 439/67 |
| 5,213,512 | 5/1993 | Campbell et al. | 439/67 |
| 5,306,160 | 4/1994 | Roberts | 439/62 |
| 5,343,616 | 9/1994 | Roberts | 29/846 |
| 5,421,738 | 6/1995 | Roberts | 439/260 |
| 5,479,110 | 12/1995 | Crane et al. | 324/757 |
| 5,549,479 | 8/1996 | Elco et al. | 439/67 |

*Primary Examiner*—Hien Vu

*Attorney, Agent, or Firm*—Paul C. Remus, Esq.; Kristin Kohler, Esq.; Devine, Millimet & Branch, P.A.

[57] ABSTRACT

A low cost, high energy direct circuit to circuit stored energy connector is disclosed. The connector precisely aligns and interconnects conductors of "flexible circuits" directly to mating contacts on printed circuit boards. The connector uses the flexible circuit conductors themselves to aid in alignment and eliminates the need for precise control of the outside dimensions of a flexible circuit's dielectric backplane or a precisely located alignment hole. The connector is a zero insertion force (ZIF) type, and is a high density surface mount. The connector comprises two major components: a connector housing and a circuit interconnection spring assembly. The housing is configured with a device for forming a direct flexible circuit conductor to printed circuit board mating contact interconnection. The circuit is retained in position by a multi-function spring assembly rotatably positionable with respect to the housing. Rotation of the spring assembly from an open to a shut position allows the spring assembly to: a) work in conjunction with the housing to positively align the circuit in position, b) pull the circuit into position within the housing, c) ensure adequate force is applied to the circuit's dielectric backplane behind each of the circuit's conductors to guarantee proper electrical connection between the circuit and the printed circuit board, and d) provide a ground return from the circuit to the printed circuit board.

31 Claims, 7 Drawing Sheets

DIRECT CIRCUIT TO CIRCUIT STORED ENERGY CONNECTOR

BACKGROUND OF THE INVENTION

In today's electronics market, manufacturers are placing emphasis on increasing their product's reliability and reducing assembly costs to remain competitive. A primary focus of each manufacturer is to reduce the cost and increase the circuit density associated with interconnecting the sub-assemblies and components found within its products. Another emerging focus in today's electronics market is to pack more electronic functions into smaller packages. This means higher density modules, each requiring multiple high density interconnections to other modules.

In electrical systems, flexible printed circuits are employed as electrical jumpers or cables for interconnecting rows of terminal pins or pads of printed circuit board. Such flexible printed circuits are generally connected to a printed circuit board using a connector. Conventional connector manufacturers compete with each other using the same basic technology, individual stamped contacts molded into a plastic housing. This structure is then soldered to a printed circuit board (printed circuit board) and is then ready to receive a flexible jumper or interconnect circuit. Many of these conventional connectors are of the zero insertion force (ZIF) variety, which require the application of minimal forces during the process of inserting the flexible circuit into the connector. These ZIF connectors thus reduce the likelihood of circuit damage during the connection process.

All of today's ZIF connectors use either the edge of the interconnect circuit or a precisely located hole to accurately align the conductors of the flexible circuit to the connector's contacts. This requires circuit manufacturers to precisely control both the thickness and width of a flexible circuit's terminating ends. Generally, tolerances must be maintained within 0.003 inches. To accurately outline a circuit and control the required tolerances requires an expensive precise outline die. Another obstacle encountered in conventional circuit connector technology centers around a tendency of flexible circuits to shrink somewhat after their manufacture. When working with larger flexible circuits, the shrinkage problem can be significant enough to result in significant alignment problems. As such, outline dies are usually constrained to outline a 6 inch by 6 inch area. This size restriction adds labor costs and reduces yield.

In addition to size restrictions, flexible circuits also require the precise attachment of a support stiffener. This stiffener is required to lift the circuits into connection with a conventional connector's contacts and add the structural support necessary to ensure the thin flexible circuit into the connector's opening. The precise outlining and stiffener attachment process is cumbersome and costly and frequently the cause of poor yields and system failures.

Conventional connectors also utilize internal spring assemblies in order to ensure that jumpers or flexible circuits maintain adequate contact with the connector's contacts. However, until now, these connectors have incorporated a single spring assembly for each conductor. The physical size required to manufacture an acceptable spring contact eliminates this technology in high-density circuits using microminiature connectors which will eventually require conductors on 0.006 inch pitch centers.

Thus, the need for a microminiature, direct circuit to circuit connector requiring minimal manufacturing costs has led to the development of the present invention.

SUMMARY OF THE INVENTION

A direct circuit to circuit stored energy connector is disclosed which is intended to be a low cost, high density connector. The connector is designed to precisely align and interconnect conductors of conductive ink circuits (CIC), flexible printed circuits (FPC), round wire interconnects (RWI) and/or flat flexible cables (FFC) (collectively referred to hereinafter as "flexible circuits") directly to mating contacts on printed circuit boards (printed circuit board). The disclosed connector relies upon the flexible circuit conductors themselves for alignment purposes and thus eliminates the need for precise control of the outside dimensions of a flexible circuit's dielectric backplane or a precisely located alignment hole. The connector is of the zero insertion force (ZIF) variety and is a high density surface mount connector capable of terminating conductors on 0.006 inch pitch centers.

The disclosed direct circuit to circuit, stored energy connector comprises two major components: a connector housing and a circuit interconnection spring assembly. The connector is configured to provide an integral circuit alignment means to ensure that a flexible circuit's conductors align properly with mating contacts on a printed circuit board. The housing is also configured with a means for forming a direct flexible circuit conductor to printed circuit board mating contact interconnection. The flexible circuit is retained in position by a multi-function spring assembly which is rotationally position with respect to the housing. When the spring assembly is rotated from an open position to a shut position, various components of the spring assembly contact the flexible circuit to: a) work in conjunction with the housing to positively align the circuit in position, b) pull the flexible circuit into position within the housing, c) ensure adequate force is applied to the flexible circuit's dielectric backplane directly behind each of the flexible circuit's conductors to guaranty proper electrical connection between the flexible circuit and the printed circuit board, d) provide a ground return from the circuit to the printed circuit board, and e) features necessary to maintain proper electrical connection between the flexible circuit and the printed circuit board and to compensate for any thickness variations in any of the interconnected components.

DETAILED DESCRIPTION OF THE PREFERRED EMBODIMENTS

Figure 1:
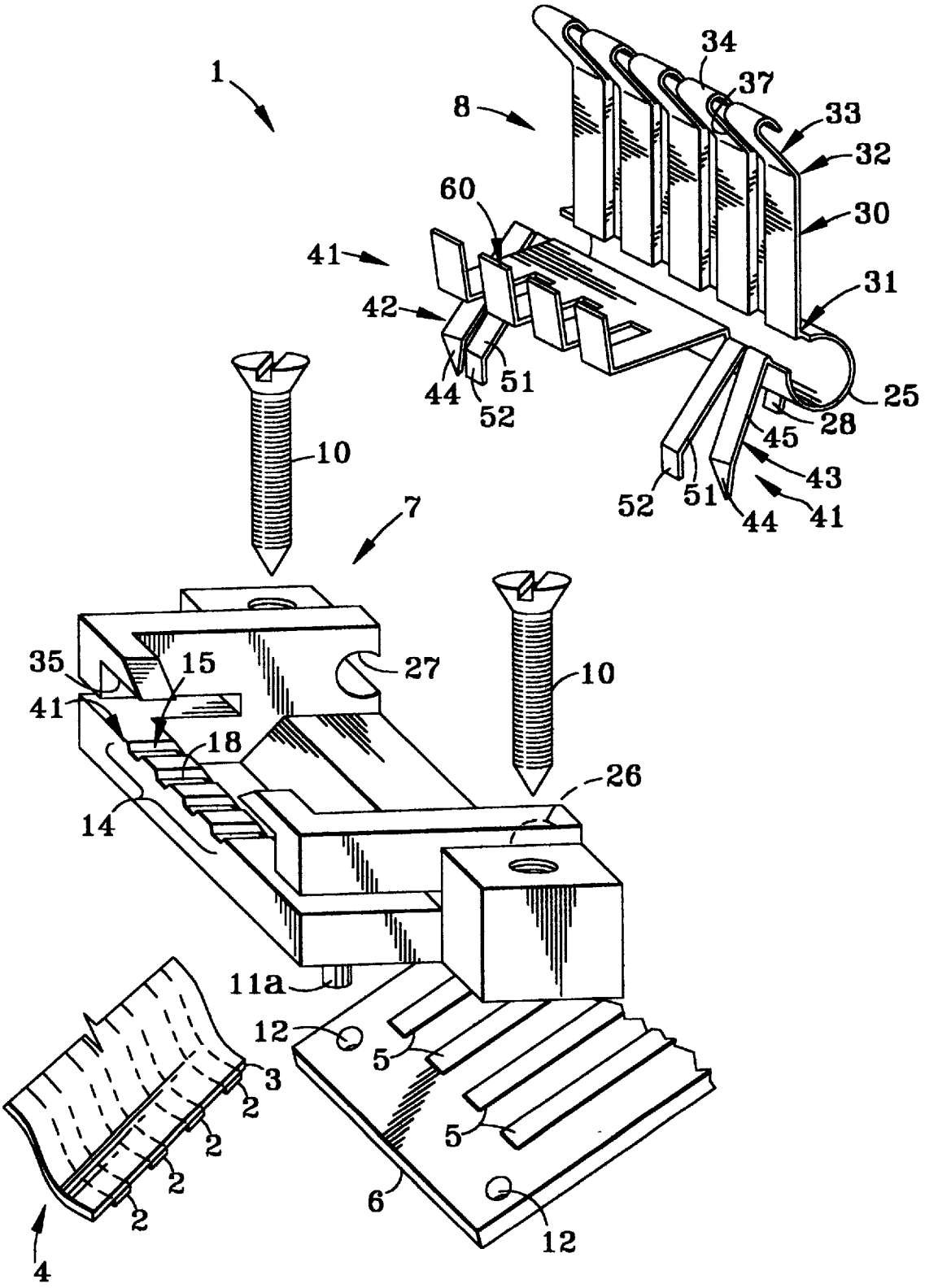
FIG. 1 is an exploded perspective view of the direct circuit to circuit stored energy connector of the disclosed invention, showing the housing, the spring assembly and a flexible circuit, which will be secured in position on a printed circuit board by the connector.
Figure 2:
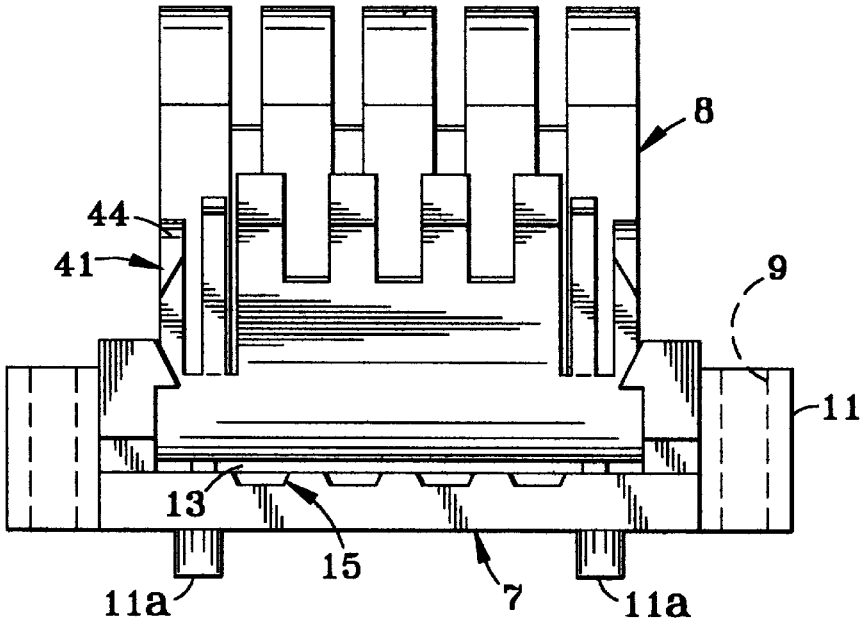
FIG. 2 is a front view of the direct circuit to circuit stored energy connector of the disclosed invention showing the spring assembly in the open position.
Figure 3:
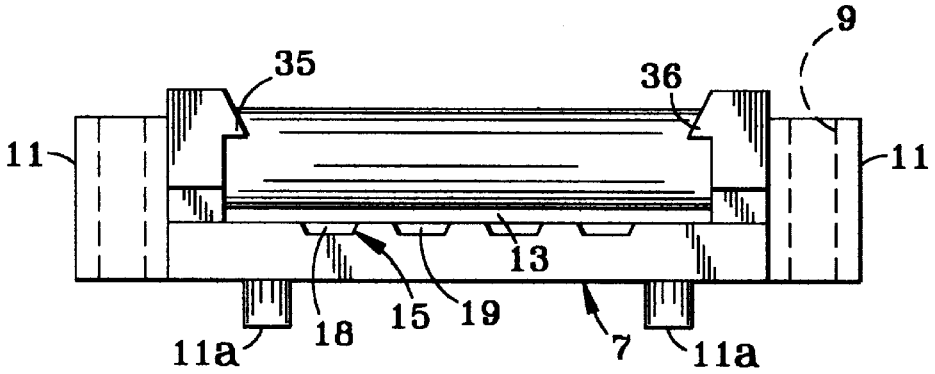
FIG. 3 is a front view of the housing.
Figure 4:
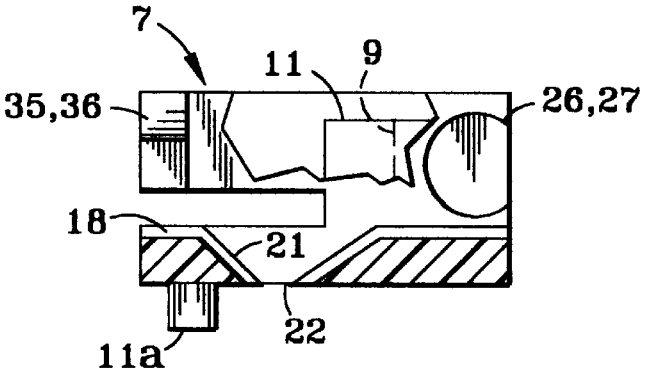
FIG. 4 is a side view of the housing.

Turning now to the figures and in particular to FIGS. 1–9*b*, a direct circuit to circuit stored energy connector 1 is shown. Connector 1 is preferably utilized to connect circuit conductors 2 disposed on one side of a flexible dielectric backplane 3 of a flexible circuit 4 to mating contacts 5 on a printed circuit board (PCB) 6. Dielectric backplane 3 serves to hold the conductors in position and electrically insulate them from each other. Each flexible circuit conductor 2 has a specified width, which may or may not be the same width as the other flexible circuit conductors.

Connector 1 comprises a molded plastic connector housing 7 and a multi-function spring assembly 8. Housing 7 is preferably mounted directly to printed circuit board 6 using attachment means 9, which, in one embodiment comprises a threaded attachment means, comprised of at least one self tapping attachment screw 10, or other threaded fastener, screwed through through-bores in end tabs 11 and into printed circuit board 6. In order to ensure that housing 7 is properly oriented on printed circuit board 6, such that the circuit conductors 2 on the flexible circuit 4 will align with the mating contacts 5 on printed circuit board 6, at least one alignment post 11*a* may be provided on the bottom face of the connector, where said connector 1 is registered to at least one alignment hole 12 on printed circuit board 6, in the alternative, an etched in feature on the printed circuit board can be used as an alignment means, such as a conductor on the printed circuit board that has been configured to align to contact arms 16 of FIG. 9*a* and, once aligned, contact arms 16 are soldered in place on the printed circuit board. The alignment posts protrude from the connector and are inserted through alignment holes 12 in printed circuit board 6.

Housing 7 is further configured to allow a printed flexible circuit 4 to be readily inserted into said connector 1 and removable retained therein in proper alignment with the printed circuit board 6. To facilitate the explanation, the figures depict a housing 7, which is configured to connect a flexible circuit having four (4) conductors to printed circuit board 6. However, it must be understood that the disclosed invention is readily adapted to facilitate the direct circuit to circuit connection of microminiature circuits, which may have conductors on 0.006 inch pitch centers or less. Therefore, a typical direct circuit to circuit conductor of the present invention could connect a flexible circuit having many dozens of flexible circuit conductors to a like number of mating conductors on a printed circuit board.

Once connector 1 is fixed in position on printed circuit board 6, flexible circuit 4 may be inserted into connector 1 at the circuit insertion opening 13. In order to facilitate the alignment of flexible circuit 4 in housing 7, the housing includes two circuit alignment means: a rough circuit alignment means 41 and a precise conductor alignment means 15.

Rough circuit alignment means 41 comprises a general alignment cavity 14 molded into the housing 7 configured to allow a flexible circuit to be inserted therein and generally located so as to prevent the precise conductor alignment means 15 from damaging the flexible circuit. The general alignment cavity 14 has a width slightly greater that the width of flexible circuit 4 so that a minimal amount of insertion force is required to insert flexible circuit 4 into circuit insertion opening 13.

The rough circuit alignment means 41, utilizes the exterior dimensions of a flexible circuit for rough alignment purposes. In addition, the housing 7 includes a precise conductor alignment means 15, which serves to align the flexible circuit conductors themselves with the mating contacts 5 on printed circuit board 6.

The precise conductor alignment means 15 comprise one tapered alignment trough 18 molded into housing 7 and corresponding to each flexible circuit conductor 2 of flexible circuit 4. When conductor pitch centers are less than 0.002", such as in ultra fine line circuits, two or more conductors may be clustered in an alignment trough. Each alignment trough 18 has an opening 19 at a top end thereof, which is sized to allow flexible circuit conductor 2 to fit therein when said flexible circuit 4 is inserted into said connector 1 and is roughly aligned therein by the general alignment cavity 14. Each alignment trough 18 is tapered to a dimension closely equal to the width of its corresponding flexible circuit conductor 2 at a bottom end 20 thereof. When terminating fine line circuits with conductors on 0.006 " pitch centers or less, a tapered alignment trough for each conductor is not dimensionally practical. In this case, a cluster of two or more conductors may share a single, tapered alignment trough. Additionally, housing 7 comprises an angled contact section 21 through which alignment troughs 18 descend. At the bottom end 20 of angled contact section 21, each alignment trough 18 has an interconnect means which may comprise a circuit pass through opening 22, sized to allow conductors 2 of flexible circuit 4 to pass therethrough and communicate directly with a mating contact 5 on printed circuit board 6. Thus, when flexible circuit 4 is pressed into position, as will be discussed below, the flexible circuit's conductors 2 will be accurately located and retained in position upon their respective mating contacts 5 on the printed circuit board 6. These alignment troughs also prevent contact misalignment and side to side conductor shifting, which would cause circuit discontinuity if the printed circuit board 6, connector 1 or printed circuit 4 were exposed to an extreme shock and/or vibration.

Once flexible circuit 4 is roughly aligned in connector 1, it must then be retained in proper position within connector 1 in such a manner that proper electrical contact is made and maintained between circuit conductors 2 and their respective mating contacts 5 on printed circuit board 6. Proper retention and electrical connection is accomplished using a novel, multi-function spring assembly 8, which is rotationally retained in housing 7.

Multi-function spring assembly 8 comprises three basic sections: pivot section 25, lever section 30, and alignment and retention section 40. The pivot section 25 is generally circular in cross section. Pivot section 25 is rotationally secured in position in a similarly sized and shaped pivot recesses 26 and 27 located on opposite sides of housing 7. In order to insert pivot section 25 into position in pivot recesses 26 and 27, the diameter of pivot section 25 is compressed to a size smaller than the diameter of pivot recesses 26 and 27 and is pressed or "snapped" into position in housing 7 or from the back. The circular cross section of the pivot section 25, in combination with similarly shaped and sized pivot recesses 26 and 27, allows spring assembly 8 to be rotationally positioned with respect to housing 7 without the need for additional hinge mechanism, pivot post or other attachment hardware. It must be understood that when the pivot section exceeds one inch in length it may be necessary to add a spring support pin to prevent bowing of the spring assembly. In this embodiment, the pivot section would rotate on a spring support pin that is of a cross-sectional thickness sufficient to insure that the multi-function spring remains rotatably fixed in its desired position. The pivot section also includes a circuit stop means 28, which in a preferred embodiment is a projection from the pivot section 25 of spring assembly 8. The circuit stop means is generally oriented along the axis of the lever section in an opposite direction thereto such that when the connector is ready to receive a flexible circuit 4 during its insertion therein, the flexible circuit contacts the circuit stop 28 and prevents further insertion thereof.

The lever section 30 has a first end 31 adjacent to pivot section 25 and a second end 32 which extends away from the first end 31. The second end 32 comprises a novel strain relief assembly 33, which further comprises generally semi-circular strain relief tabs 34. When a flexible circuit 4 is being held in position in connector 1 strain relief tabs 34 will engage and retain the flexible circuit 4 where the circuit extends out of connector 1. If the flexible circuit is stressed, for example by an individual pulling on flexible circuit 4, the strain relief tabs 34 will deflect and disperse the forces being applied to the flexible circuit across the entire width of the flexible circuit where the circuit engages and retains strain relief tabs 34. This form of force dispersion will result in fewer circuit discontinuities resulting from the mishandling of circuits, printed circuit boards and/or connectors.

The lever section 30 is also sized so that it will be removably retained in a shut position when it is so positioned within connector 1. When lever section 30 is rotated from its open position to its shut position, lever section is pressed between spring locking barbs 35 and 36 located on either side of housing 6. Spring locking barbs 35 and 36 are oriented so that the lever section 30 of spring 8 can be easily pressed into position but cannot be removed without first spreading the locking barbs 35 and 36 horizontally. As lever section 30 is pressed into position, the outer portions of lever section 30 slide along sloped sections 35*a* and 36*a* of barbs 35 and 36 respectively, until lever section 30 has passed the sloped sections 35*a* and 36*a*. A portion of lever section 30 rests underneath barbs 35 and 36. In order to removed lever section 30, barbs 35 and 36 are spread horizontally in the direction of the arrows shown in FIG. 1. Furthermore, lever section 25 may include corrugated ridges 37 along its longitudinal axis, i.e. in a direction extending from its first end to its second end, to add structural support.

Figure 5:
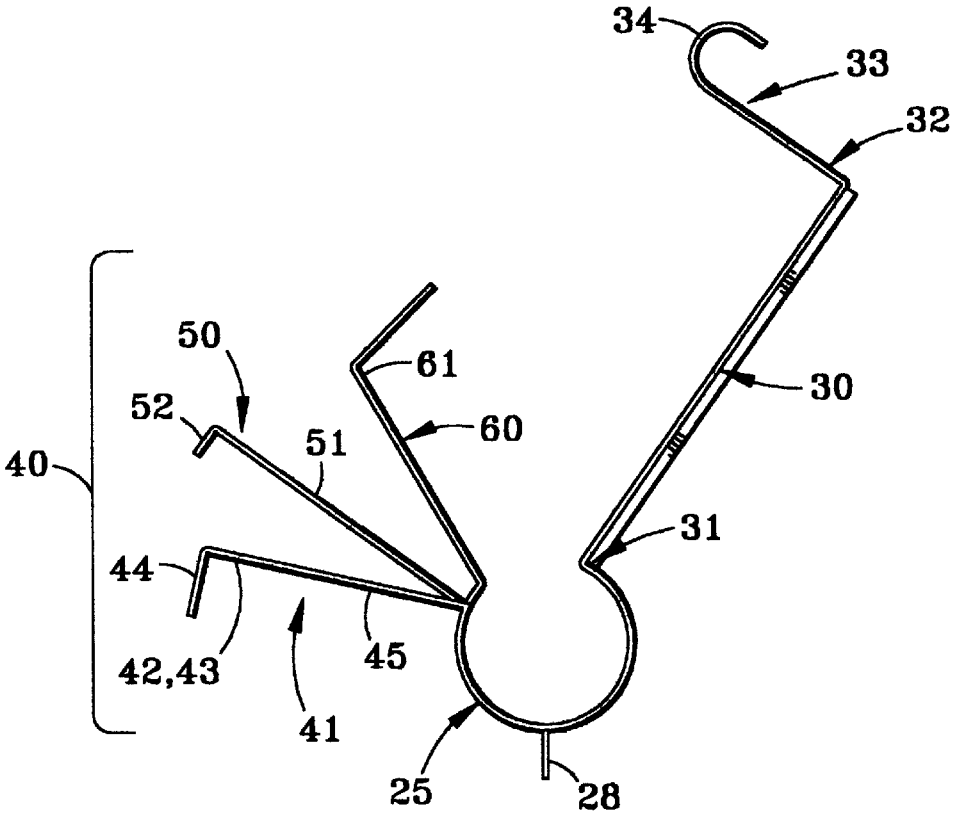
FIG. 5 is a side view of the spring assembly.
Figure 6:
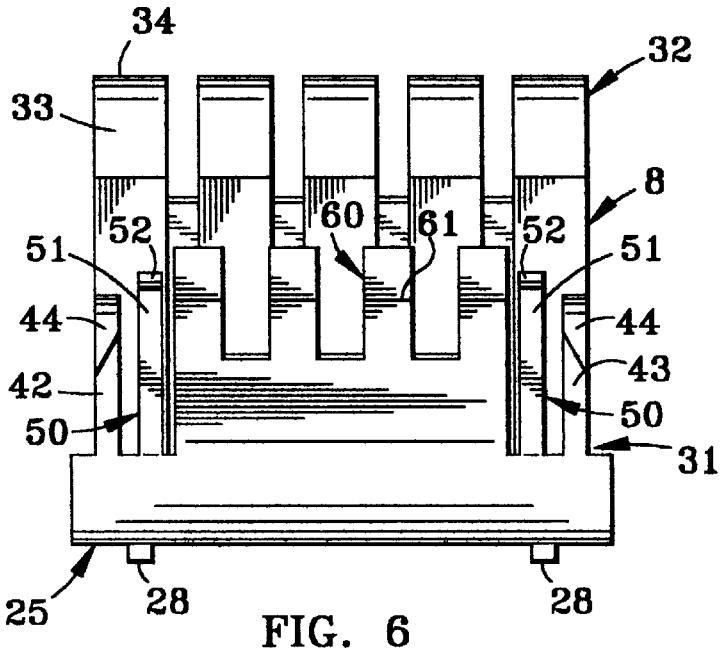
FIG. 6 is a front view of the spring assembly.

The alignment and retention section 40 comprises three major components. The first major component is the circuit alignment means 41, which comprises wigglers 42 and 43. Wigglers 42 and 4 each comprise generally tapered protrusions 44, which extend generally downward from wiggler alignment arms 45. FIG. 5 illustrates the alignment arms 45 projecting from the pivot section 25 of spring 8 in a manner such that as spring assembly 8 is rotationally positioned from its open position to its shut position, the tapered protrusions 44 of wigglers 42 and 43 are the first sections of the spring assembly 8 to make contact with flexible circuit 4.

Figure 7A:
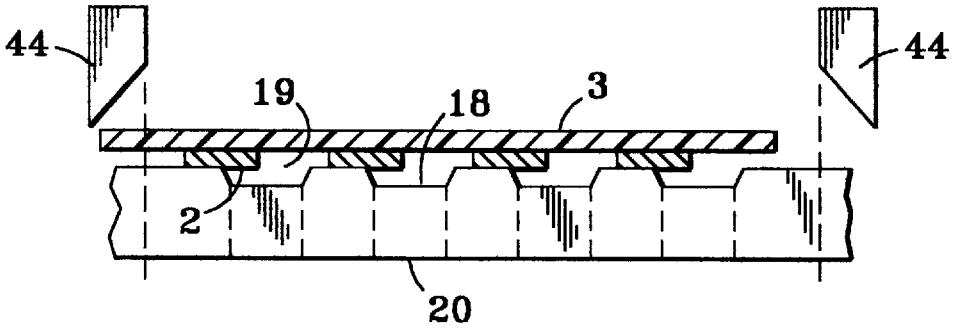
FIG. 7*a* is a front view of a portion of the direct circuit to circuit stored energy connector of the disclosed invention showing a first step of the circuit alignment sequence.
Figure 7B:
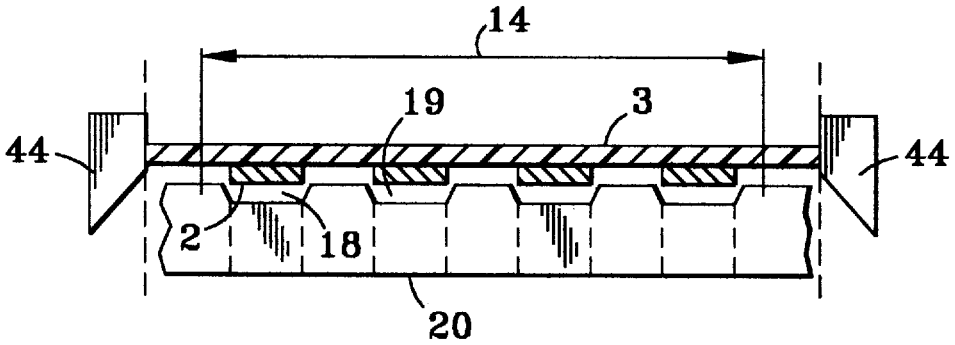
FIG. 7*b* is a front view of a portion of the direct circuit to circuit stored energy connector of the disclosed invention showing a second step of the circuit alignment sequence.
Figure 7C:
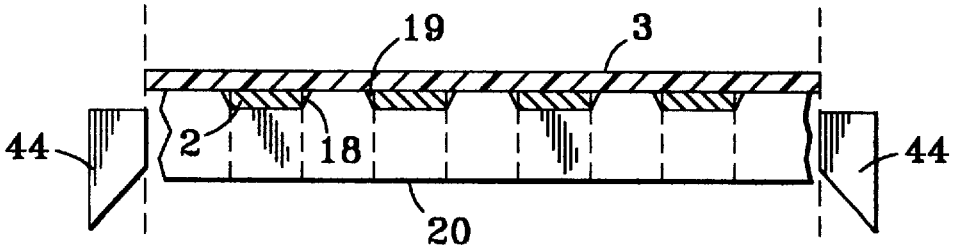
FIG. 7*c* is a front view of a portion of the direct circuit to circuit stored energy connector of the disclosed invention showing a third step of the circuit alignment sequence.
Figure 8A:
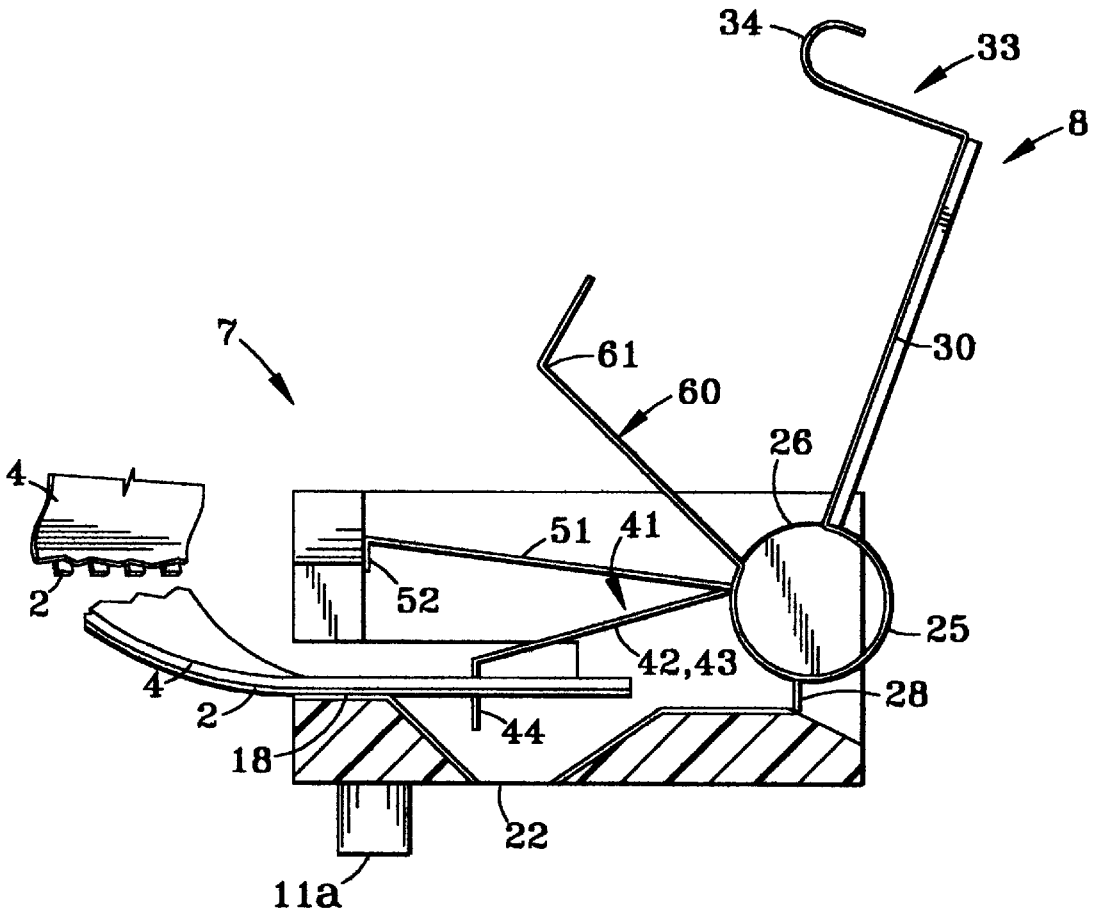
FIG. 8*a* is a side view of one embodiment of the direct circuit to circuit stored energy connector showing the housing with the spring assembly attached therein in the open position.
Figure 8B:
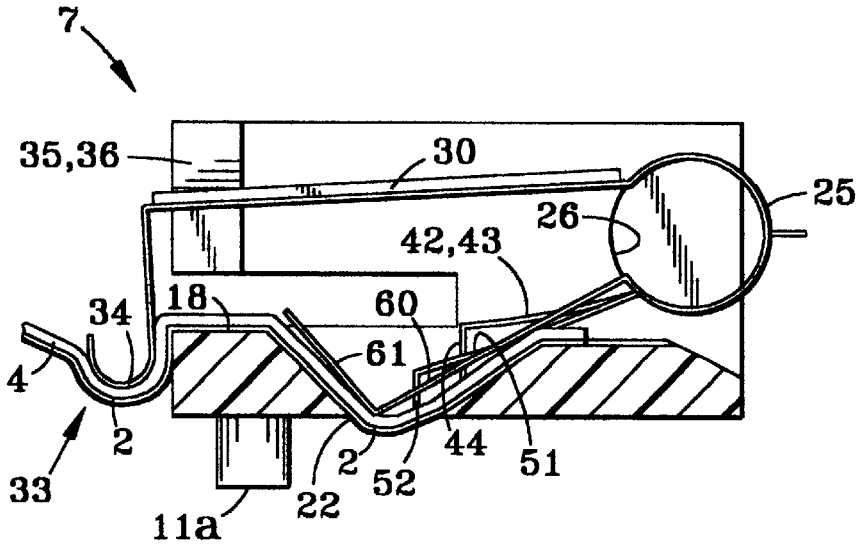
FIG. 8*b* is a side view of one embodiment of the direct circuit to circuit stored energy connector showing the housing with the spring assembly attached therein in the shut position.
Figure 9A:
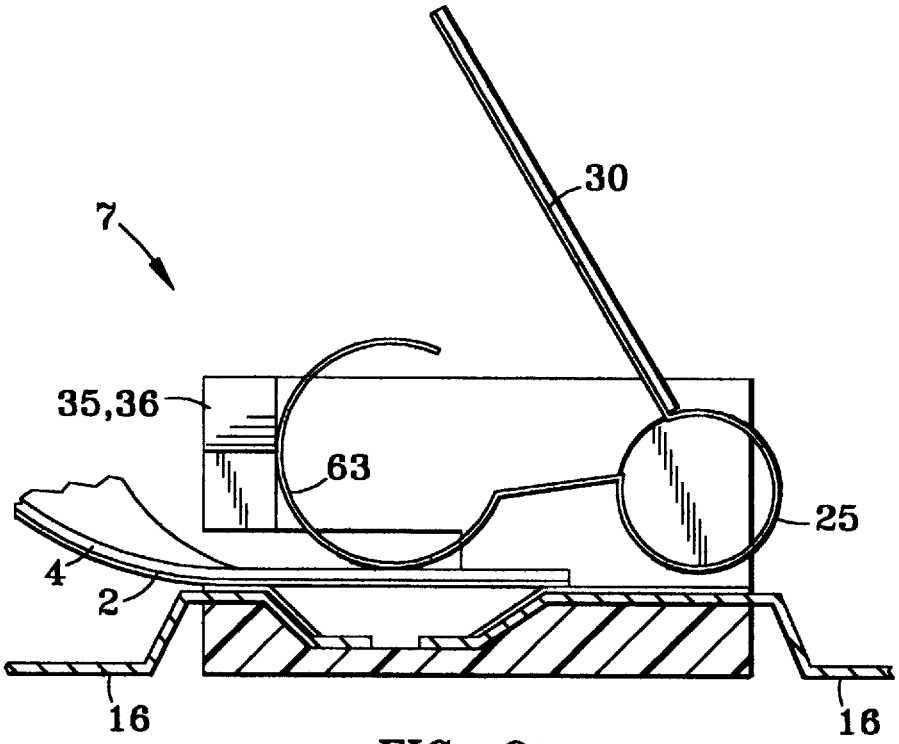
FIG. 9*a* is a side view of another embodiment of the direct circuit to circuit stored energy connector showing the housing with a compression equalizing spring assembly attached therein in the open position.
Figure 9B:
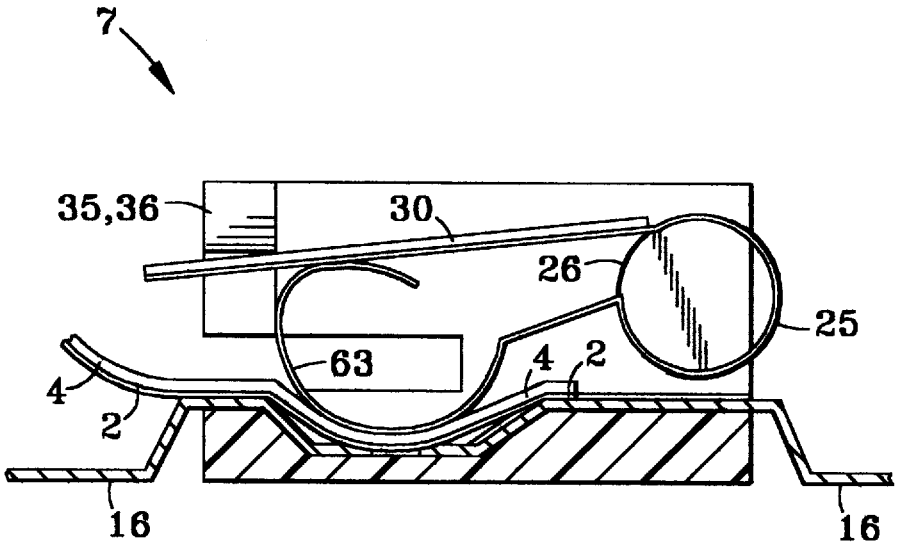
FIG. 9*b* is a side view of another embodiment of the direct circuit to circuit stored energy connector showing the housing with a compression equalizing spring assembly attached therein in the shut position.

Viewing FIGS. 7*a*, 7*b* and 7*c*, it can be seen that protrusions 44 of wigglers 42 and 3 contact flexible circuit 4 on either side thereof and serve to roughly align the flexible circuit's conductors 2 with the top opening 19 of each tapered alignment trough 18. The rough alignment sequence operates as follows: first, as spring assembly 8 is rotationally positioned towards its shut position, tapered protrusions 44 of wigglers 42 and 43 engage either side of flexible circuit 4 and laterally locate flexible circuit 4 such that each circuit conductor 2 roughly aligns with the top opening 19 of its corresponding alignment trough 18; second, as spring assembly 8 is further rotated, tapered protrusions 44 of wigglers 42 and 43 roughly center flexible circuit 4 over the alignment troughs 18; and third, as spring assembly 8 is further rotated, wigglers 42 and 43 disengage the now centered flexible circuit 4 by passing below the plane of flexible circuit 4.

The second major component of the alignment and retention section 40 of spring assembly 8 is a grabber means 50. The grabber means 50 which completes the circuit alignment process by pulling the flexible circuit 4 into the tapered conductor alignment troughs 18. Illustrated in FIGS. 1 and 5, grabber means 50 comprises at least two grabber arms 51. These grabber arms 51 extend from the pivot section 25 of spring 8 at an angle such that a downwardly extending grabber 52, on each arm 51, does not come in contact with the flexible circuit 4 until the circuit has been roughly aligned in alignment troughs 18 by wigglers 42 and 43. Illustrated in FIGS. 8*a* and 8*b*, each grabber 52 completes the circuit alignment process by contacting or piercing the dielectric backplane 3 of the flexible circuit 4. Further, the flexible circuit 4 is pulled into the housing 7, and sufficient force is exerted thereon such as to propel the conductors 2 into proper position in the alignment troughs 18. Each grabber 52 is designed to have a beam length sufficient to allow a minimum of 0.001" to 0.005" horizontal movement necessary to accommodate the final alignment of the flexible circuit 4 to the alignment troughs 18. In addition, grabber 52 operates in conjunction with housing 7 to provide a wiping mechanism as grabber 52 pulls flexible circuit 4 into position in housing 7. This will aid in the removal of any oxidation or foreign material that could form on the exposed conductors 2 of flexible circuit 4, which would degrade electrical connection.

The third major component of the alignment and retention section 40 of spring 8 comprises at least one stored energy spring arm 60. Each spring arm 60 extends away from the pivot section 25 of spring 8 at an angle intermediate the angle that the grabber arms 52 extend from the pivot section 25 and the angle the lever section 30 extends from the pivot section 25 of spring 8. Each spring arm 60 itself comprises a compression section 61. Compression section 61 is shaped to ensure that adequate pressure is applied to each conductor 2 of flexible circuit 4 through the dielectric backplane 3 of flexible circuit 4 when it is retained in connector 1. Preferably each compression section 61 will exert substantially 150 grams of force on each conductor 2 of flexible circuit 4.

In one embodiment of the invention, compression section 61 comprises a simple bend in spring arm 60 at a point along its length corresponding to the point at which spring arm 60 will contact the dielectric backplane 3 of flexible circuit 4. This simple bend forms a compliant extension on spring arm 60 designed to apply the required force to ensure adequate electrical contact. Further, the simple bend compensates for thickness variations in the flexible circuit's dielectric backplane 3, the flexible circuit's conductors 2, the mating contacts 5 on printed circuit board 6, or any combination thereof. The angle of the bend in spring arm 60 is chosen so that the shape of the bent spring arm approximates the shape of the angled contact section 21 of housing 7.

Optional force concentrators may be formed in spring arm 60 to further compensate for thickness variations and the like. These optional force concentrators may take the form of additional bends in spring arm 60 or additional appendages attached to spring arm 60 in its compression section 61.

In another embodiment of the invention, compression section 61 of spring arm 60 comprises at least one compression equalizer 63, which is substantially circular in cross section. The size of the circular cross section is chosen such that when spring assembly 8 is rotated into the shut position and is held in place by spring locking barbs 35 and 36, the lever section 30 of spring 8 presses against the circular compression equalizer 63 of spring arm 60. The compressive forces exerted by the lever section 30 upon the circular compression equalizer 63 of spring arm 60 ensures that adequate pressure is transmitted by spring arm 60 upon the dielectric backplane 3 of flexible circuit 4 where it passes through the contact section 21 of housing 7.

In yet another embodiment of the invention, the grabber and an electrically-conductive wiggler may be used to create a pressure interconnect by applying substantially 150 grams of contact force against the surface of the shield or ground layer of flexible circuit 4 and in so doing creating a gas tight electrical interconnect between the spring and flexible circuit. The electric signal is carried through the spring and to a ground connector on the printed circuit board through the electrically-conductive wiggler that has been lengthened and configured to carry a ground return and directly connect it to the printed circuit board.

Springs made out of beryllium copper have proved effective in both the workability requirements necessary to form the complex shapes necessary for the disclosed invention and for providing the required contact force necessary to assure proper flexible circuit conductor to printed circuit board mating contact electrical connections. In another embodiment of the invention, said multi-function spring assembly 8 may be made out of a resilient moldable material such as glass reinforced nylon. This material offers both the workability requirements necessary to form the complex shapes necessary for the disclosed invention and for providing the required contact force necessary to assure proper flexible circuit conductor to printed circuit board mating contact electrical connection.

Figure 10A:
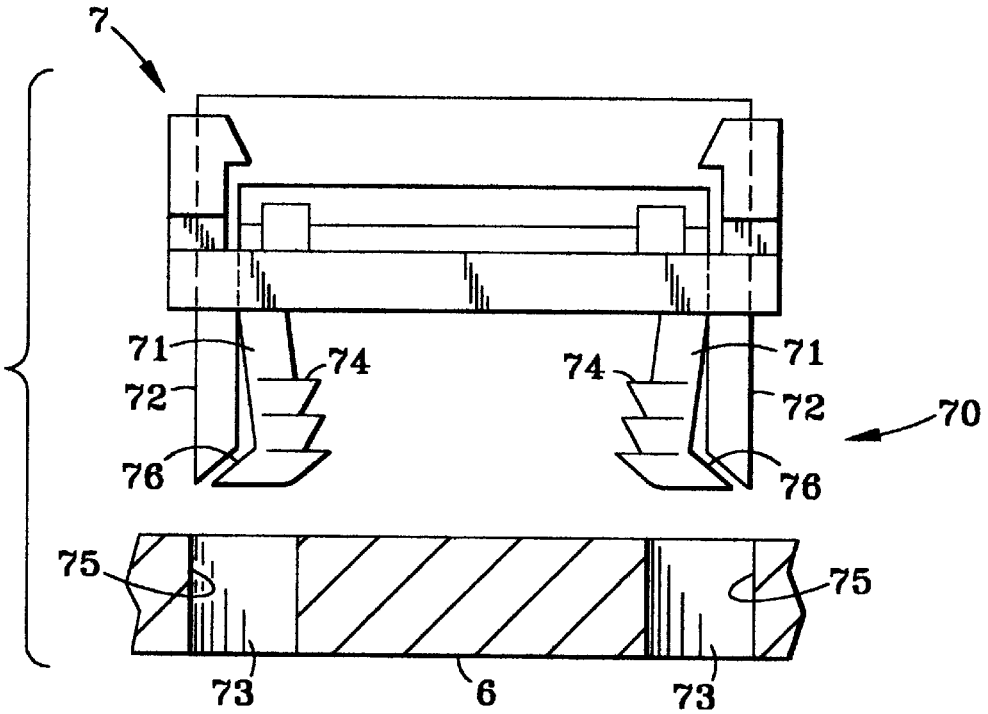
FIG. 10*a* is a front view of the housing of the direct circuit to circuit stored energy connector showing a tapered locking post, swage locking clip attachment means for holding the connector housing in position on a printed circuit board.
Figure 10B:
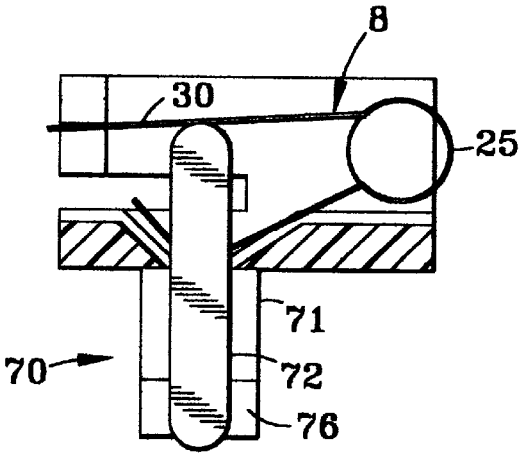
FIG. 10*b* is an end view of the housing of the direct circuit to circuit stored energy connector showing the tapered locking post, swage locking clip attachment means for holding the connector housing in position on a printed circuit board in the shut position.
Figure 10C:
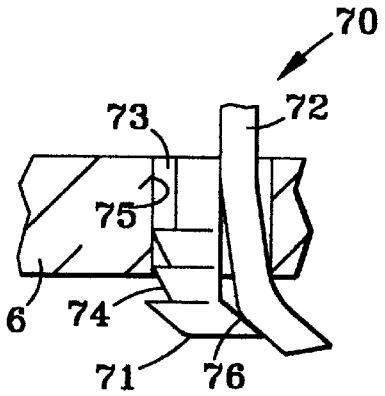
FIG. 10*c* is a front view of the tapered locking post, swage locking clip attachment means in the shut position where it penetrates the printed circuit board.

An additional feature of the disclosed stored energy connector is a novel attachment means 70 for attaching connector 1 to printed circuit board 6. Illustrated in FIGS. 10*a*, 10*b* and 10*c*, attachment means 70 comprises at least one tapered locking post 71 and swage locking clip 72. Tapered locking post 71 is sized to slide through a hole 73 in printed circuit board 6. Only a minimal amount of force is needed since the dimension of tapered locking post 71 is somewhat smaller than that of hole 73. Tapered locking post 71 preferably comprises a series of barbs 74 to ensure that once locking post is fixed in position, it cannot be easily jarred loose from printed circuit board 6 as either the printed circuit board 6 or flexible circuit 4 is placed under stress.

Connector 1 is located in position on printed circuit board 6 by aligning tapered locking post 71 with hole 73 and pressing connector 1 onto printed circuit board 6. Pressing connector 1 forces tapered locking post 71 to deflect from its normal, unloaded position by wall 75 of hole 73. The pressure exerted upon wall 75 by barbs 74 of locking post 71 will tend to hold connector 1 in position on printed circuit board 6. However, to ensure connector 1 is rigidly held in position even under stress, each locking post 71 is compressed against wall 75 even further by swage locking clip 72.

Swage locking clip 72 may be formed as an additional and integral part of spring assembly 8 or it may be an additional stand alone part. In either embodiment, as spring assembly 8 is rotated from the open position to the shut position, swage locking clip 72 is compressed into hole 73 adjacent tapered locking post 71. When the bottom of swage locking clip 72 exits through the bottom of hole 73 in printed circuit board 6, it impinges upon an angled protrusion 76, which protrudes from tapered locking post 71 opposite barbs 74. Angled protrusion 76 forces swage locking clip 72 to bend in a direction away from barbs 74, which firmly compresses the sides of locking clip 72 against tapered locking post 71 and wall 75 of hole 73, which rigidly retains connector 1 in position on printed circuit board 6.

Various other changes coming within the scope of the invention may suggest themselves to those skilled in the art: hence, the invention is not limited to the specific embodiment shown or described, but the same is intended to be merely exemplary. It should be understood that numerous other modifications and embodiments can be devised by those skilled in the art that will fall within the spirit and scope of the principles of the invention.

What is claimed is:

1. A direct circuit to circuit, stored energy connector for interconnecting a flexible circuit having a plurality of electrical conductors backed by a flexible dielectric backplane directly to a plurality of mating contacts on a printed circuit board, said connector comprising a non-electrically conductive housing, a multi-function spring assembly, and attachment means for rigidly mounting said housing directly to said printed circuit board, wherein said housing comprises an alignment means for directly aligning said plurality of electrical conductors with said plurality of mating contacts and an interconnect means for allowing said plurality of electrical conductors to communicate directly with said plurality of mating contacts, and wherein said multi-function spring assembly applies sufficient force upon said flexible dielectric backplane of said flexible circuit to assure adequate electrical connection between said flexible circuit and said plurality of mating contacts of said printed circuit board, wherein said alignment means comprises a rough circuit alignment means comprises a plurality of circuit alignment troughs corresponding to said plurality of electrical conductors and tapering to corresponding conductors on a printed circuit board, each said alignment trough having a top opening, a tapered side wall and a bottom dimension, wherein said top opening has a width greater than the width of a corresponding plurality of electrical conductors such that when said flexible circuit is inserted into a flexible circuit insertion opening, at least one circuit wiggler will roughly align said flexible circuit in such a manner that each of said plurality of electrical conductors will rest within said top opening of its corresponding circuit alignment trough and wherein said bottom dimension of each said alignment trough is substantially equal to the width of said plurality of electrical conductors.

2. The direct circuit to circuit, stored energy connector of claim 1, wherein said connector comprises a circuit alignment cavity.

3. The direct circuit to circuit, stored energy connector of claim 1, further comprising an angled contact section through which each of said alignment troughs descends, said contact section opening at a circuit pass through opening located at the bottom of said connector to said printed circuit board such that when said flexible circuit is inserted into said connector, said plurality of electrical conductors will penetrate through the bottom of said connector and communicate directly with mating contacts on said printed circuit board.

4. The direct circuit to circuit, stored energy connector of claim 3, wherein said multi-function spring assembly comprises a pivot section, a lever section and an alignment and retention section.

5. The direct circuit to circuit, stored energy connector of claim 4, wherein said pivot section is generally cylindrical and is rotationally secured in position in said housing by inserting a first and a second end of said cylindrical pivot section into similarly sized and shaped pivot recesses located in said housing.

6. The direct circuit to circuit, stored energy connector of claim 5, wherein said pivot section further comprises a circuit stop to assist in the location of said flexible circuit as it is inserted into said connector.

7. The direct circuit to circuit, stored energy connector of claim 6, wherein said circuit stop comprises a projection from said pivot section of said spring assembly configured to locate said plurality of electrical conductors over said circuit pass through opening.

8. The direct circuit to circuit, stored energy connector of claim 4, wherein said lever section has a first end adjacent said pivot section and a second end which extends away from said first end to allow a rotational force to be exerted upon said lever section in order to rotate said spring assembly between an open and a shut position.

9. The direct circuit to circuit, stored energy connector of claim 8, wherein said lever section further comprises a strain relief assembly located at said second end of said lever section, said strain relief assembly comprising generally semi-circular strain relief tabs configured to communicate with said flexible dielectric backplane of said flexible circuit when said flexible circuit is being held in position in said connector where said flexible circuit enters said connector.

10. The direct circuit to circuit, stored energy connector of claim 8, wherein said lever section further comprises corrugated ridges extending along an axis extending from its first end to its second end to provide said lever section with structural rigidity.

11. The direct circuit to circuit, stored energy connector of claim 6, wherein said alignment and retention section comprises an alignment means, a grabber means, an electrical ground return and at least one stored energy spring arm.

12. The direct circuit to circuit, stored energy connector of claim 11, wherein said alignment means comprises at least one circuit wiggler, each said circuit wiggler comprising an alignment arm and forming a generally tapered protrusion, extending in a downward direction from said alignment arm, each said wiggler is configured to operate in conjunction with said rough circuit alignment means of said housing to roughly align said flexible circuit in position within said connector.

13. The direct circuit to circuit, stored energy connector of claim 12, wherein each said wiggler independently and sequentially engages and moves the flexible circuit in a first direction and then in a second direction.

14. The direct circuit to circuit, stored energy connector of claim 11, wherein said grabber means comprises at least one grabber arm, said grabber arm extending from said pivot section of said spring assembly and further comprising a downwardly extending grabber wherein said grabber: contacts said flexible circuit when said circuit has been roughly aligned in said housing; pierces said dielectric backplane of said flexible circuit; and pulls said flexible circuit into said connector housing.

15. The direct circuit to circuit, stored energy connector of claim 14, wherein at least one grabber means and at least one electrically-conductive wiggler provides a circuit shield to printed circuit board ground by electrically connecting a shield layer of said flexible circuit to a ground conductor on said printed circuit board through said electrically-conductive wiggler.

16. The direct circuit to circuit, stored energy connector of claim 14, wherein said grabber arm comprises a beam length sufficient to allow a minimum of about 0.001" to 0.005" horizontal movement.

17. The direct circuit to circuit, stored energy connector of claim 11, wherein each said stored energy spring arm comprises a compression section, said compression section configured to apply adequate pressure to said dielectric backplane of said flexible circuit to establish and maintain proper electrical connection between each said electrical conductors and respective plurality of mating contacts on said printed circuit board.

18. The direct circuit to circuit, stored energy connector of claim 17, wherein said compression section comprises a simple bend in said spring arm at a position along its length corresponding to a contact point on said dielectric backplane substantially behind where said plurality of electrical conductors communicate with said plurality of mating contacts on said printed circuit board such that said compression section directs spring force substantially in line with said plurality of electrical conductors and said plurality of mating contacts and wherein said simple bend forms an angle in said spring arm approximating said shape of said angled contact section of said connector housing.

19. The direct circuit to circuit, stored energy connector of claim 18, wherein each said spring arm further comprises a force concentrator located at said position where said spring arm communicates with said contact point on said dielectric backplane.

20. The direct circuit to circuit, stored energy connector of claim 1, wherein said multi-function spring assembly is made of a resilient metal spring material.

21. The direct circuit to circuit, stored energy connector of claim 20, wherein said resilient metal spring material is beryllium copper.

22. The direct circuit to circuit, stored energy connector of claim 1, wherein said multi-function spring assembly is made of a resilient moldable material.

23. The direct circuit to circuit, stored energy connector of claim 22, wherein said resilient moldable material is glass reinforced nylon.

24. The direct circuit to circuit, stored energy connector of claim 1, wherein said multi-function spring assembly is self supporting.

25. The direct circuit to circuit, stored energy connector of claim 1, further comprising a spring support pin wherein said multi-function spring assembly rotates on said spring support pin.

26. The direct circuit to circuit, stored energy connector of claim 1, wherein said attachment means comprises at least one end tab on at least one side of said housing, said end tab having a through-bore through which a threaded fastener is threaded and fastened to said printed circuit board.

27. The direct circuit to circuit, stored energy connector of claim 26, wherein said threaded fastener is a self-tapping screw, wherein said self-tapping screw is screwed through said through-bore and directly into said printed circuit board.

28. The direct circuit to circuit, stored energy connector of claim 27, wherein said threaded fastener comprises a threaded bolt, wherein said threaded bolt is threaded through said through-bore and said printed circuit board and held in position with a nut.

29. The direct circuit to circuit, stored energy connector of claim 26, wherein said attachment means further comprises at least one alignment post protruding from said housing, wherein each said alignment post communicates with at least one alignment hole in said printed circuit board.

30. The direct circuit to circuit, stored energy connector of claim 1, wherein said attachment means comprises at least one tapered locking post and swage locking clip, said tapered locking post sized to penetrate said printed circuit board through an attachment hole therein and said swage locking clip is sized to be wedged into said attachment hole along with said tapered locking post to exert sufficient pressure upon said attachment hole walls to rigidly hold said connector in position on said printed circuit board.

31. The direct circuit to circuit, stored energy connector of claim 30, wherein said tapered locking post further comprises a plurality of barbs, wherein said barbs communicate with said attachment hole walls.

* * * * *